United States Patent [19]

Payson

[11] 4,338,850

[45] Jul. 13, 1982

[54] ADJUSTABLE MUFFLER FOR PERCUSSION INSTRUMENT

[76] Inventor: Albert E. Payson, 2130 Glenview Ave., Park Ridge, Ill. 60068

[21] Appl. No.: 213,959

[22] Filed: Dec. 8, 1980

[51] Int. Cl.[3] ..... G10D 13/02

[52] U.S. Cl. ..... 84/411 M

[58] Field of Search ..... 84/411 R, 411 M, 415–417, 84/411 A, 411 P, 412–414, 418–421

[56] References Cited

U.S. PATENT DOCUMENTS

| | | | |
|---|---|---|---|
| 573,320 | 12/1896 | Boulanger | 84/411 |
| 663,853 | 12/1900 | Boulanger | 84/411 M |
| 2,499,616 | 2/1946 | Walberg | 84/411 |
| 2,572,504 | 1/1950 | Meriwether | 84/411 |
| 4,154,137 | 5/1979 | Kobayashi | 84/411 M |
| 4,244,266 | 1/1981 | Hardy | 84/411 M |

*Primary Examiner*—L. T. Hix
*Assistant Examiner*—Benjamin R. Fuller
*Attorney, Agent, or Firm*—Lee, Smith & Jager

[57] ABSTRACT

An adjustable muffler for a percussion instrument, such as a bass drum. The muffler includes a supple material which is situated contiguous to the head of the drum, one or more elastic strips to maintain the supple material in contiguous relationship with the drum head, and a cord situated to selectively withdraw successive portions of the supple material from contiguous relationship to the drum head in order to alter the degree of muffling produced. The supple material, which may be of felt, fur or any other suitable soft, flexible material, lies adjacent only a portion of the drum head bounded by a chord and the circumference of the drum head. The cord is attached through the top of the supple material and is located so that as the cord is tensioned, successive portions of the supple material are selectively withdrawn from contiguous relationship to the drum head. The cord passes through an aperture in the shell of the percussion instrument and is marked with indicia bearing a direct relationship to the degree of withdrawal of the muffler from the drum head so that the user can readily adjust the degree of muffling without having to actually observe the position of the muffler itself.

11 Claims, 9 Drawing Figures fig.1.
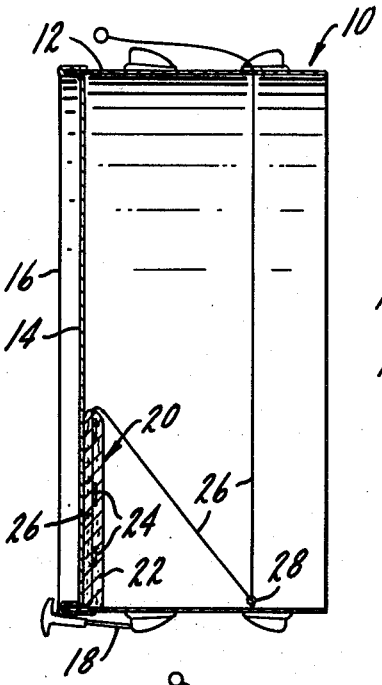
fig.2.
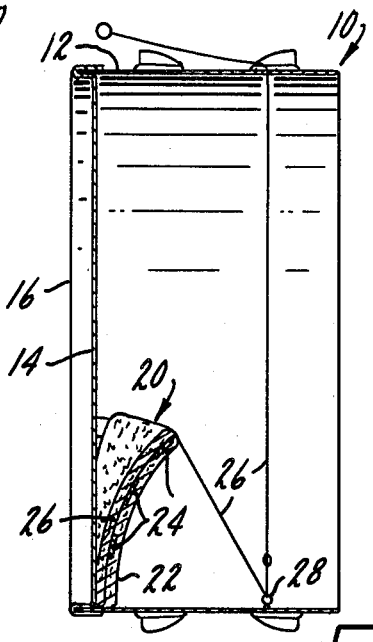
fig.3.
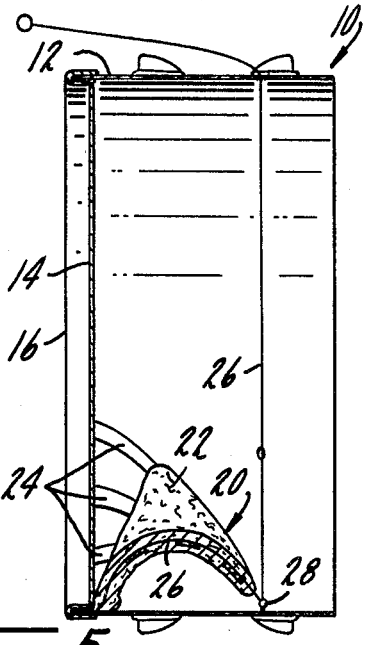
fig.5.
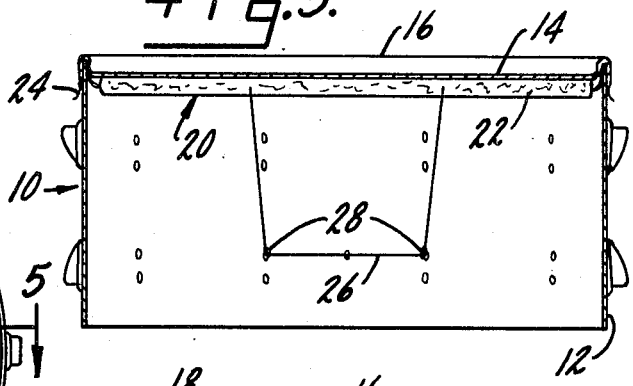
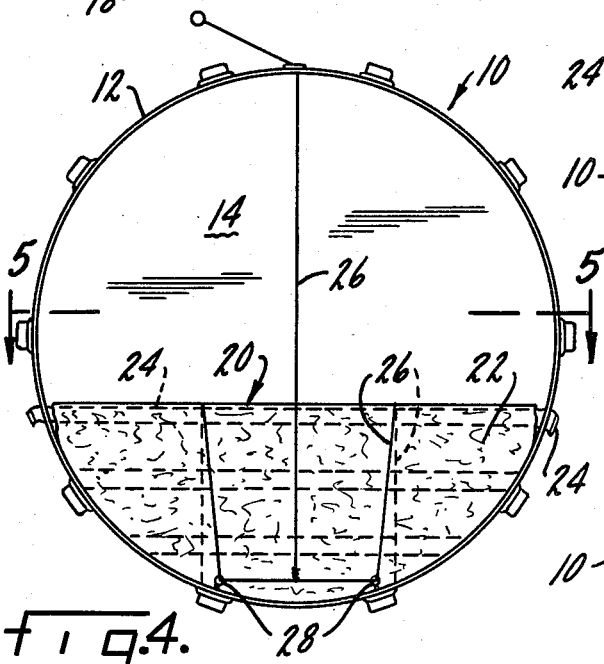
fig.4.
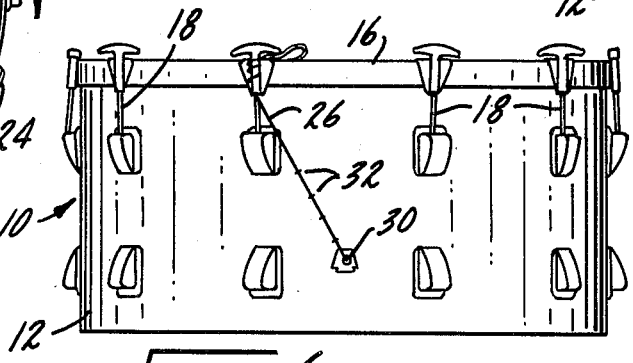
fig.6.
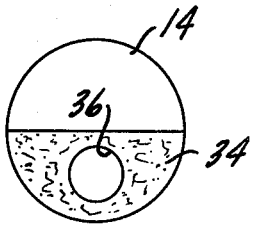
fig.7.
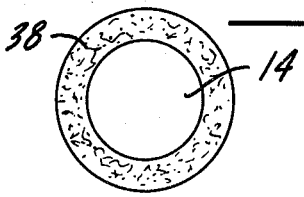
fig.8.
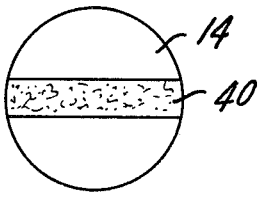
fig.9.

ADJUSTABLE MUFFLER FOR PERCUSSION INSTRUMENT

BACKGROUND OF THE INVENTION

This invention relates to mufflers for percussion instruments such as bass drums, and in particular to a muffler which is adjustable and does not change the pitch of the sound emanating from the percussion instrument as the degree of muffling is altered.

Mufflers for percussion instruments, such as drums and tomtoms, are well known. There are passive mufflers, which comprise pads or the like which are affixed to a drum head or membrane, and active mufflers, which bear against the drum head with varying degrees of intensity in order to alter the vibratory characteristics of the drum head, and therefore muffle the sound emanating from the drum.

Mufflers which apply pressure to the drum head must necessarily also alter the pitch of the sound emanating from the drum. This result is undesirable since a drum is normally considered to be a single tone instrument. In addition, most such active mufflers are located on the exterior of the drum, intruding into the playing area and often creating an unsightly adjunct to the drum itself.

Several mufflers have been developed for mounting substantially within the drum interior, thus avoiding detraction from the drum's exterior appearance. Such mufflers are shown, for example, in U.S. Pat. Nos. 573,320; 663,853; 2,499,616; 2,572,504 and 4,154,137. However, since the muffling device of each of these patents bears against the drum head, the pitch of the sound emanating from the drum is often changed depending on the amount of pressure with which the muffling device bears against the drum head. Also, the mufflers are composed of several mechanically connected metal parts, which can tend to rattle and loosen, adding extraneous noise. In addition, the degree of muffling is often difficult to ascertain independently without striking the drum head and listening to the muffled effect. Obviously, this testing procedure cannot be accomplished in the midst of a musical composition.

SUMMARY OF THE INVENTION

The invention provides an adjustable muffler for a percussion instrument which can muffle sound between a maximum degree of muffling and no muffling at all, or at any gradation in between those two limits, without varying the pitch of the sound emanating from the instrument. The invention also avoids any metal parts or linkages which can vibrate when the instrument is struck, thus creating an extraneous sound.

The invention is adapted to be installed within a percussion musical instrument, such as a drum or tom-tom, which includes a flat membrane or head for producing audible tones when struck and a rigid shell upon which the membrane is mounted. The muffler is adjustable for selectively muffling the audible tones of the percussion musical instrument without perceptively changing the pitch of the audible tones. The muffler includes a supple material situated contiguous to a portion of the membrane, means to maintain the supple material in contiguous relationship to the membrane, and means to selectively withdraw successive portions of the supple material from contiguous relationship to the membrane in order to alter the degree of muffling of the audible tones.

Typically, the membrane is circular and, in the preferred embodiment, the supple material lies in a geometric area bounded by a chord and the circumference of the membrane. Alternatively, the supple material can comprise a strip situated about the circumference of the membrane. In another alternative embodiment of the invention, the supple material may comprise a strip of material situated across the membrane. If desired, the supple material can be apertured for the appropriate tonal response and degree of muffling desired.

The supple material is maintained in contiguous relationship with the membrane by means of one or more elastic strips which pass through the supple material and are secured to the rigid shell. The strips are tensioned laterally across the membrane rather than toward the membrane so that little, if any pressure is exerted by the muffler upon the membrane.

The invention includes a retraction cord attached to the muffler and which is located to withdraw the muffler away from the membrane. The cord passes through the rigid shell in sufficient length to be clamped to or wrapped around an exterior part of the shell so that the supple material can be retained at a predetermined degree of withdrawal from contiguous relationship to the membrane. The cord includes indicia indicative of the degree of withdrawal of the supple material from contiguous relationship to the membrane, such as unique markings at spaced intervals.

BRIEF DESCRIPTION OF THE DRAWINGS

The invention is described in greater detail in the following description of the preferred embodiments, taken in conjunction with the drawings, in which:

FIG. 1 is a cross-sectional elevational side illustration of the invention showing the muffler disposed within a percussion instrument at its full muffling position, with portions of the percussion instrument being omitted for clarity, FIG. 2 is a cross-sectional elevational side illustration similar to FIG. 1, but showing the muffler selectively withdrawn to a certain degree, FIG. 3 is a cross-sectional elevational side illustration similar to FIG. 1, but showing the muffler withdrawn to the full extent, FIG. 4 is a rear elevational illustration of a percussion instrument and the muffler according to the invention, showing the muffler in the full muffling position, as in FIG. 1, FIG. 5 is a cross-sectional illustration taken along lines 5—5 of FIG. 4, FIG. 6 is a top illustration of a percussion instrument including the muffler internally situated therewithin, with an adjustment cord extending through an aperture in the shell of the instrument and wrapped about one of the head clamps to maintain a predetermined degree of withdrawal of the muffler from the membrane of the percussion instrument, FIG. 7 is a schematic illustration of an alternative embodiment of the muffler, which includes a central aperture, FIG. 8 is another alternative embodiment of a muffler which is situated circumferentially around the circumference of the membrane of the percussion instrument, and FIG. 9 is another alternative embodiment of the muffler which comprises a strip of material situated across the membrane of the percussion instrument.

DESCRIPTION OF THE PREFERRED EMBODIMENTS

The invention is constructed for mounting within the interior of a percussion instrument, such as a drum or tom-tom 10. The drum 10, of conventional design, includes a rigid shell 12 and a flat membrane 14 which is stretched taut across the shell 12. The membrane is held in place by a circumferential ring 16 which is secured to the shell 12 by means of a series of tension rods and clamps 18, which are spaced about the shell 12 in a conventional fashion. For the sake of clarity, only certain of the clamps 18 have been shown in FIGS. 1 through 6, it being understood that a required number of the clamps 18 would be utilized in a normal manner not forming part of the present invention.

A muffler according to the invention is depicted generally at 20 in the drawings. It comprises a supple material 22, such as felt, fur, fabric or the like which is held in contiguous relationship to the membrane 14 by means of a plurality of elastic strips 24. The supple material 22 may be in one or more layers, as desired. The strips 24 are clamped by the ring 16 to the shell 12, extending slightly from the exterior of the drum 10 as shown, and are laterally tensioned across the membrane 14 to maintain the muffler 20 in the orientation shown in FIGS. 1 and 4. That is, the supple material 22 lies in contiguous relationship to the membrane 14 in a geometric area bounded by a chord and the circumference of the membrane 14.

In order to alter the degree of muffling of the muffler 20, it is adapted so that successive portions of the supple material 22 may be selectively withdrawn from contiguous relationship to the membrane 14. As shown in the drawings, a cord 26 is attached to the muffler 20. Preferably, the cord 26 passes through the supple material 22, as best shown in FIGS. 1 through 4, and is clamped by the ring 16 to the rigid shell 12 in the same manner as are the strips 24. Twin legs of the cord 26 extend from the supple material 22, passing through a pair of eyes 28 affixed to the rigid shell 12. From the eyes, the cord legs join and the cord 26 passes through an aperture 30 in the top of the shell 12 (FIG. 6). If the shell 12 is provided with a conventional air hole, the aperture 30 may comprise that air hole.

The portion of the cord 26 that extends through the aperture 30 is of sufficient length so that it may be wrapped about one of the clamps 18. Additionally, the cord 26 is provided with indicia 32 in the form of markings or color coding such that the amount of cord withdrawn through the aperture 30 may be readily determined, and correspondingly the degree of withdrawal of the supple material 22 from contiguous relationship to the membrane 14 may also be determined.

In use, the muffler 20 is situated within a drum 10 as shown and described above. For full muffling, the muffler is left in the relationship shown in FIGS. 1 and 4. However, to reduce the degree of muffling, the supple material 22 is selectively withdrawn from the membrane 14 by pulling the cord 26 through the aperture 30. As shown in FIGS. 2 and 3, as the cord 26 is withdrawn through the aperture 30, successive portions of the supple material 22 are withdrawn from the membrane 14. The user may readily determine the degree of withdrawal by observing the indicia 32 on the cord 26 as the cord is drawn through the aperture 30. When the desired degree of muffling is achieved, the cord 26 is wrapped or tied about one of the clamps 28. Thus, the supple material is securely held in position until a different degree of muffling is desired.

As shown schematically in FIG. 7, an alternative embodiment of a muffler is shown in relationship to a membrane 14. Remaining portions of a drum are omitted for simplicity, and may be identical to those shown in FIGS. 1 through 6. The muffler comprises a supple material 34 having an aperture 36, which reduces the maximum degree of muffling achieved by the supple material 34. The material 34 may be held in position by elastic strips (not illustrated) and may be withdrawn by a cord (not illustrated) in exactly the same manner shown with relationship to FIGS. 1 through 6 and described above.

FIG. 8 illustrates another embodiment of the invention in which a supple material 38 is situated circumferentially about the membrane 14. The material 38 may be tensioned across the membrane 14 by elastic strips (not illustrated), and can be successively withdrawn from the membrane 14 by a cord (not illustrated) in the same manner as described above with regard to FIGS. 1 through 6.

Finally, FIG. 9 depicts yet another embodiment of the invention in which a strip of supple material 40 is situated across the membrane 14. Again, elastic strips (not illustrated) can be used to maintain the supple material 40 in relationship to the membrane 14, and a cord (not illustrated) can be used to successively withdraw the supple material, in accordance with the description of FIGS. 1 through 6.

ACHIEVEMENTS

The invention is adjustable to muffle a percussion instrument to a maximum extent, or to be fully withdrawn from the muffling relationship, or any degree of gradation in between. It does not apply pressure to the vibratory membrane, and therefore does not change the pitch of the percussion instrument depending on the degree of muffling achieved.

The muffler according to the invention is located within the percussion instrument, therefore not detracting from the external appearance of the percussion instrument, but is operated externally by the user. Adjustment can be made very quickly and accurately due to adjustment indicia carried by the cord 26. The user can adjust the muffler 20 without changing his position (e.g., bending over toward the floor), and adjustment can be effectuated readily with one hand.

The invention includes no metal parts or linkages which could vibrate against the membrane 14 or which can rattle, creating extraneous sound each time the membrane 14 is struck.

Various changes may be made to the invention without departing from the spirit thereof or scope of the following claims.

What is claimed is:

1. In a percussion musical instrument having a flat membrane for producing audible tones when struck and a rigid shell upon which said membrane is mounted, the improvement comprising an adjustable muffler for selectively muffling the audible tones of the instrument without perceptively changing the pitch of the audible tones, said muffler having a. a supple material situated contiguous to and laterally across a portion of said membrane, b. means to maintain said material in continguous relationship to said membrane without pressing against said membrane, and c. means to selectively withdraw successive portions of said supple material from contiguous relationship to said membrane in order to alter the degree of muffling of the audible tones.

2. A percussion musical instrument according to claim 1 in which said membrane is essentially circular and said supple material occupies a geometric area bounded by a chord and the circumference of said membrane.

3. A percussion musical instrument according to claim 1 in which said membrane is essentially circular and said supple material comprises a strip situated about the circumference of said membrane.

4. A percussion musical instrument according to claim 1 in which said supple material comprises a strip of material situated across said membrane.

5. A percussion musical instrument according to claim 1 in which said means to maintain comprises an elastic strip passing through said supple material and secured to said shell.

6. A percussion musical instrument according to claim 5 including means clamping the membrane to the rigid shell, and in which said strip is secured to said shell by said clamping means.

7. A percussion musical instrument according to claim 5 in which said strip is tensioned laterally across said membrane.

8. A percussion musical instrument according to claim 1 in which said muffler is situated within the percussion musical instrument and in which said means to selectively withdraw comprises a retraction cord attached to said muffler and located to withdraw said muffler away from said membrane.

9. A percussion musical instrument according to claim 8 in which said cord passes through the rigid shell and said cord includes indicia indicative of the degree of withdrawal of said supple material from contiguous relationship to said membrane.

10. A percussion musical instrument according to claim 1 including means to retain said supple material at a predetermined degree of withdrawal from contiguous relationship to said membrane.

11. An adjustable muffler for selectively muffling the audible tones of a percussion musical instrument having a flat membrane for producing audible tones when struck and a rigid shell upon which the membrane is mounted, the muffler comprising a. a supple material shaped to engage and lie laterally across a portion of the membrane, b. elastic means for maintaining said material in contiguous relationship to the membrane without pressing against said membrane, and c. an elongate cord attached to said material for selectively withdrawing successive portions of said supple material from contiguous relationship to the membrane in order to alter the degree of muffling of the audible tones.

* * * * *